US011618485B2

(12) United States Patent
Coseglia

(10) Patent No.: US 11,618,485 B2
(45) Date of Patent: Apr. 4, 2023

(54) END GUIDE SYSTEM AND METHOD FOR A TRUCK ASSEMBLY OF A RAIL VEHICLE

(71) Applicant: Amsted Rail Company, Inc., Chicago, IL (US)

(72) Inventor: John Arthur Coseglia, Edwardsville, IL (US)

(73) Assignee: Amsted Rail Company, Inc., Chicago, IL (US)

( * ) Notice: Subject to any disclaimer, the term of this patent is extended or adjusted under 35 U.S.C. 154(b) by 219 days.

(21) Appl. No.: 17/190,625

(22) Filed: Mar. 3, 2021

(65) Prior Publication Data

US 2021/0300444 A1 Sep. 30, 2021

Related U.S. Application Data

(60) Provisional application No. 63/002,417, filed on Mar. 31, 2020.

(51) Int. Cl.

| | |
|---|---|
| ***B61F 5/04*** | (2006.01) |
| ***B61F 5/14*** | (2006.01) |
| ***B61F 5/52*** | (2006.01) |
| ***B61F 5/00*** | (2006.01) |
| *B61F 3/02* | (2006.01) |

(52) U.S. Cl.

CPC ..... *B61F 5/04* (2013.01); *B61F 5/00* (2013.01); *B61F 5/14* (2013.01); *B61F 5/52* (2013.01); *B61F 3/02* (2013.01)

(58) Field of Classification Search

CPC ..... B61F 3/00; B61F 3/02; B61F 5/00; B61F 5/04; B61F 5/06; B61F 5/08; B61F 5/10; B61F 5/12; B61F 5/122; B61F 5/14; B61F 5/50; B61F 5/52

See application file for complete search history.

(56) References Cited

U.S. PATENT DOCUMENTS

| | | | | |
|---|---|---|---|---|
| 2,045,299 A * | 6/1936 | Hedgcock | B61F 5/12 | 105/197.05 |
| 2,473,010 A * | 6/1949 | Clasen | B61F 5/52 | 105/197.2 |
| 2,717,558 A * | 9/1955 | Shafer | B61F 5/122 | 105/197.05 |

(Continued)

FOREIGN PATENT DOCUMENTS

| | | |
|---|---|---|
| CA | 913996 | 11/1972 |
| CN | 105537529 | 5/2016 |
| EP | 0646511 | 4/1995 |

OTHER PUBLICATIONS

U.S. Pat. No. 987,013, issued Mar. 14, 1911, to Pulliam.

(Continued)

*Primary Examiner* — Amy R Weisberg
*Assistant Examiner* — Cheng Lin
(74) *Attorney, Agent, or Firm* — The Small Patent Law Group LLC; Joseph M. Butscher

(57) ABSTRACT

A truck assembly of a rail vehicle includes a side frame including a spring seat below an opening. The spring seat includes a locating pocket. An end guide system is coupled to the side frame. The end guide system includes a central base configured to be received and retained by the locating pocket. At least one end guide extends outwardly and upwardly from the central base.

20 Claims, 6 Drawing Sheets

(56) References Cited

U.S. PATENT DOCUMENTS

| | | | | | |
|---|---|---|---|---|---|
| 2,793,029 | A | * | 5/1957 | Shafer | B61F 5/122 267/211 |
| 2,805,630 | A | * | 9/1957 | Couch | B61F 5/122 105/198.5 |

OTHER PUBLICATIONS

Notification of Transmittal of The International Search Report and the Written Opinion for PCT/US2021/020772, dated May 31, 2021.

* cited by examiner

END GUIDE SYSTEM AND METHOD FOR A TRUCK ASSEMBLY OF A RAIL VEHICLE

RELATED APPLICATIONS

This application relates to and claims priority benefits from U.S. Provisional Patent Application No. 63/002,417, filed Mar. 31, 2020, which is hereby incorporated by reference in its entirety.

FIELD OF THE DISCLOSURE

Embodiments of the present disclosure generally relate to truck assemblies for rail vehicles, such as rail cars, and, more particularly, to truck assemblies that include brake beam end guides coupled to side frames.

BACKGROUND OF THE DISCLOSURE

Rail vehicles travel along railways, which have tracks that include rails. A rail vehicle includes one or more truck assemblies (or freight trucks) that support one or more car bodies. Each truck assembly includes two side frames and a bolster. Friction shoes are disposed between the bolster and the side frames. The friction shoes are configured to provide damping for suspension.

Freight rail vehicles often include a car body that carries bulk items, finished goods, and the like. The car body includes a center sill that extends under the car body from a first end to an opposite second end. Coupling systems are attached at the ends of the center sill. The coupling systems couple the rail vehicle to adjoining rail vehicles.

Bolsters are proximate to the ends of the center sill. The bolsters extend laterally across and under the car body. The bolsters extend and attach to the center sill from both sides. A center plate is centrally located on the car body bolster and positioned under the center sill.

A truck assembly typically has a centrally-located center plate or bowl. A center plate of the car body typically seats on the center plate or bowl of the truck assembly. A vertical load of the car body is transferred from the center plate to the center bowl or plate of the truck assembly. Typically, the truck assembly is configured to rotate about an interface between the center plates or bowls.

Typical truck assemblies in North America are standardized. The distance between wheel sets of a truck assembly is referred to as the wheelbase. Wheelbases of truck assemblies are generally standardized to allow room for brake beams to operate between the bolster and the wheels.

During a manufacturing process, side frames and bolsters may be assembled without fasteners. The bolster is inserted in a wider bottom portion of a center opening in each side frame (referred to as a bolster opening), is raised up through a narrower upper portion (referred to as the columns), and then coil springs are installed between the bottom of the bolster end and the bottom of the side frame bolster opening (referred to as spring seats).

Generally, there are two brake beams per truck assembly. The brake beams are configured to apply friction blocks to the treads of the wheels to stop rolling motion of the wheels. Each brake beam is supported by their ends in slot shaped brake beam end guides that are integrally cast in a side frame. The location of the ends guides is standardized vertically and longitudinally from each axle center and are also positioned outside the lower bolster opening of the side frame, thereby maintaining proper orientation of each friction block to the wheel, allowing normal assembly of the side frames and bolster, and safely preventing the brake beam from falling on a track on which the truck assembly is supported.

Wheel diameters of truck assemblies are typically standardized by capacity. For example, a 220,000 lb. capacity truck assembly uses 33" diameter wheels, a 286,000 lb. capacity truck assembly uses 36" wheels, and a 315,000 lb. capacity truck assembly uses 38" wheels.

Further, the wheelbases are standardized by capacity. For example, a 220,000 lb. capacity truck has 68" wheelbase, a 286,000 lb. capacity truck has a 70" wheelbase, and a 315,000 lb. capacity truck has a 72" wheelbase.

In certain situations, the aforementioned standards may not perform as desired. For example, there may be a situation that calls for a 220,000 lb. capacity truck assembly with 33" wheels, but a 60" wheelbase, which is 8" shorter than the standard. Because the brake beam end guides are located relative to each axle center, they are approximately 4" into a bolster opening of a side frame, thereby making it difficult, if not impossible, to assemble the side frames and bolsters in a conventional manner.

Traditionally, the solution to this problem has been to use brake beams without end guides, suspended by steel hangers that pivot from cast hanger brackets on the top center member of the side frame. Additional safety devices are required to prevent the brake beam from falling on the track if a hanger were to break. However, certain parts may be obsolete, and replacements may be difficult to find. Further, the hangers create clearance issues with the bolster. Additionally, clearance has to be provided at a particular area of the bolster. Also, the hangers require a narrow side frame column and prevent modern wide shoe designs from being applied.

SUMMARY OF THE DISCLOSURE

A need exists for an effective and efficient system and method for adapting brake beam end guides to unconventional, modified, or otherwise different types of truck assemblies for a rail vehicle. Further, a need exists for a brake beam end guide that is configured for use with non-standard truck assemblies.

With those needs in mind, certain embodiments of the present disclosure provide a truck assembly of a rail vehicle. The truck assembly includes a side frame including a spring seat (for example, a support base) below an opening (for example, a bolster opening). The spring seat includes a locating pocket (for example, a guide pocket). An end guide system is removably coupled to the side frame. The end guide system includes a central base configured to be received and retained by the locating pocket, and at least one end guide extending outwardly and upwardly from the central base.

In at least one embodiment, at least one end guide extends outwardly and upwardly from the central base at an angle in relation to the central base. For example, the angle is between 10-20 degrees.

In at least one embodiment, the at least one guide includes a first end guide extending from a first end of the central base, and a second end guide extending from a second end of the central base. The second end is opposite from the first end.

In at least one embodiment, the central base, the first end guide, and the second end are integrally molded and formed or cast as a single piece.

In at least one embodiment, the central base is longitudinally and laterally constrained within the locating pocket.

As an example, the locating pocket includes one or both of a rim or one or more tabs that retain or otherwise orient the central base within the locating pocket. Further, as an example, the side frame further includes ramps extending upwardly from an upper surface of the spring seat at opposite ends. Each of the ramps may include a channel or spring pocket. A plurality of tabs extend upwardly from the spring seat. An internal rim extends upwardly from the spring seat. The locating pocket is defined between the upper surface of the spring seat, the ramps, and the internal rim.

In at least one embodiment, one or more springs exert a downward force into the central base of the end guide system. At least a portion of the central base is sandwiched between the one or more springs and the spring seat of the side frame.

Certain embodiments of the present disclosure provide an end guide system configured to removably secure to a side frame of a truck assembly of a rail vehicle. The end guide system includes a central base configured to be received and retained by a locating pocket of the side frame, and at least one end guide extending outwardly and upwardly from the central base.

Certain embodiments of the present disclosure provide a method for a truck assembly of a rail vehicle. The method includes removably coupling an end guide system to a side frame. The side frame includes a spring seat below an opening. The spring seat includes a locating pocket.

DETAILED DESCRIPTION OF THE DISCLOSURE

Figure 1:
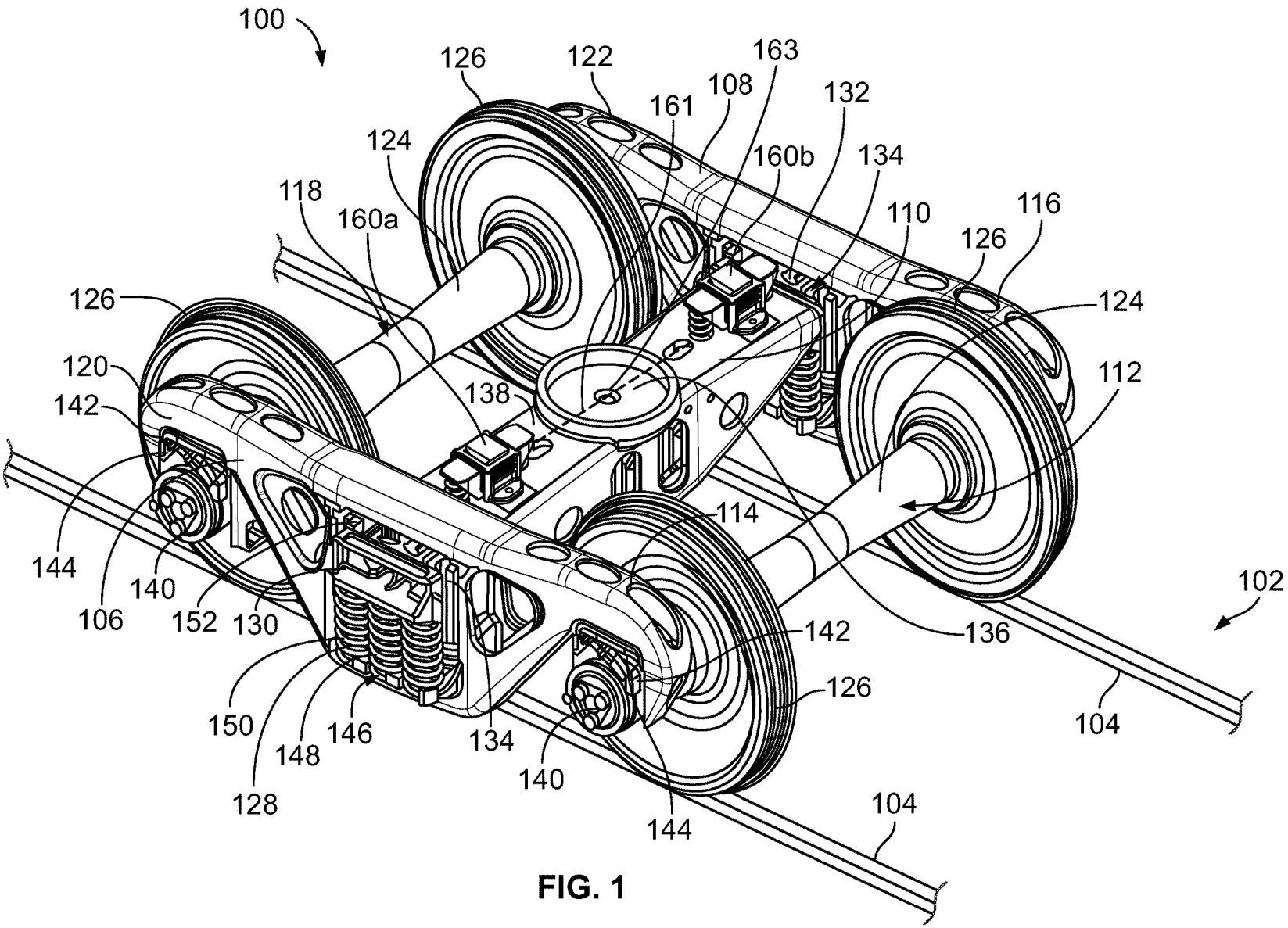
FIG. 1 illustrate a perspective top view of a truck assembly, according to an embodiment of the present disclosure.

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Certain embodiments of the present disclosure provide a truck assembly of a rail vehicle. The truck assembly includes a side frame including a spring seat below an opening. The spring seat includes a locating pocket. An end guide system is removably coupled to the side frame. The end guide system includes a central base configured to be received and retained by the locating pocket. At least one end guide extends outwardly and upwardly from the central base.

In at least one embodiment, a first end guide extends from a first end of the central base, and a second guide extends from a second end of the central base. The second end is opposite from the first end. In at least one example, the central base, the first end guide, and the second end are integrally molded and formed as a single piece.

The central base is longitudinally and laterally constrained within the locating pocket. As an example, the locating pocket includes one or more of a perimeter rim or one or more tabs that retain the central base within the locating pocket.

In at least one embodiment, one or more springs exert a downward force into the central base of the end guide system. At least a portion of the central base is sandwiched between the one or more springs and the spring seat of the side frame.

Certain embodiments of the present disclosure provide an end guide system that is configured to removably secure to a side frame of a truck assembly of a rail vehicle. The end guide system includes a central base configured to be received and retained by a locating pocket of the side frame, and at least one end guide extending outwardly and upwardly from the central base.

Certain embodiments of the present disclosure provide a side frame and removable brake beam end guides. The side frame having removable end guides allows for the use of modern truck mounted or wagon mounted brake systems, and makes it possible to use modern wide shoe technology for better performance. Further, the truck assembly can be assembled in a normal manner, with the exception of installing the brake beam end guides, which may be done at a time of overhaul, for example.

In at least one embodiment, an end guide system may be an integrally formed structure, such as a single casting that incorporates both end guides in a single casting and may be primarily held in place by suspension springs. Optionally, one or more fasteners (such as screws, bolts, and/or the like) may be used to secure the end guides in place. The side frame mechanically captures and support at least a portion of the end guide system.

Alternatively, instead of an end guide system having integral end guides at opposite ends, separate and distinct end guides may be used. For example, certain embodiments provide individual end guides, supported underneath by shelves on the side frame, and held in place with a key feature and bolts.

FIG. 1 illustrate a perspective top view of a truck assembly 100, according to an embodiment of the present disclosure. The truck assembly 100 is configured to travel along a track 102 having rails 104. The truck assembly 100 includes a first side frame 106 and a second side frame 108, which are spaced apart from one another. A bolster 110 extends between the first side frame 106 and the second side frame 108, and couples the first side frame 106 to the second side frame 108. The bolster 110 shown in FIG. 1 is exemplary. It is to be understood that the bolster 110 can be sized, shaped, and configured differently than shown.

A first wheel set 112 is rotatably coupled to first ends 114 and 116 of the first side frame 106 and the second side frame 108, respectively, and a second wheel set 118 is rotatably coupled to second ends 120 and 122 of the first side frame 106 and the second side frame 108, respectively. Each of the first and second wheel sets 112 and 118 includes an axle 124 connected to wheels 126. The wheels 126 are supported on the rails 104 and are configured to travel thereon as the axles 124 rotate in relation to the first side frame 106 and the second side frame 108.

The first and second side frames 106 and 108 includes damper or suspension systems 128. For example, the suspension systems 128 include one or more springs, friction shoes, and the like that are configured to dampen forces exerted into and/or by the truck assembly 100 as the truck assembly 100 travels along the track 102. The first and second side frames 106 and 108 shown in FIG. 1 are exemplary. It is to be understood that the first and second side frames 106 and 108 can be sized, shaped, and configured differently than shown.

The bolster 110 includes ends 130 and 132 (for example a first end 130 and an opposite second end 132), which extend through openings 134 of the side frames 106 and 108. The bolster 110 also includes a bolster center bowl 136 outwardly extending from an upper surface 138. As shown, the bolster center bowl 136 is centrally located on the upper surface 138 of the bolster 110 between the ends 130 and 132.

Ends of the axles 124 are rotatably retained by bearings 140, which are coupled to the side frames 106 and 108. In particular, the wheel sets 112 and 118 are coupled to the side frames 106 and 108 at pedestals 142 of the side frames 106 and 108. The pedestals 142 connect to bearing adapters 144 that connect to the bearings 140.

In at least one embodiment, the suspension systems 128 include spring groups 146 supported within the openings 134 of the side frames 106 and 108. The spring groups 146 include load coils 148 and control coils 150. The load coils 148 support the bolster 110 at the ends 130 and 132. The control coils 150 support friction shoes 152. The damping systems 128 shown in FIG. 1 are exemplary. It is to be understood that the damping systems 128 can be sized, shaped, and configured differently than shown.

In at least one embodiment, a first side bearing assembly 160*a* is mounted on the top surface 138 of the bolster 110 between the bolster center bowl 136 and the end 130. A second side bearing assembly 160*b* is mounted on the top surface 138 of the bolster 110 between the bolster center bowl 136 and the end 132. The side bearing assembly 160*a* and the side bearing assembly 160*b* may be aligned along a central longitudinal plane 161 of the bolster 110 that passes through a center 163 of the bolster center bowl 136. Each side bearing assembly 160*a* and 160*b* may be spaced from the center 163 the same distance, but in opposite directions. The side bearing assemblies 160*a* and 160*b* shown in FIG. 1 are exemplary. It is to be understood that the side bearing assemblies 160*a* and 160 can be sized, shaped, and configured differently than shown.

Figure 2:
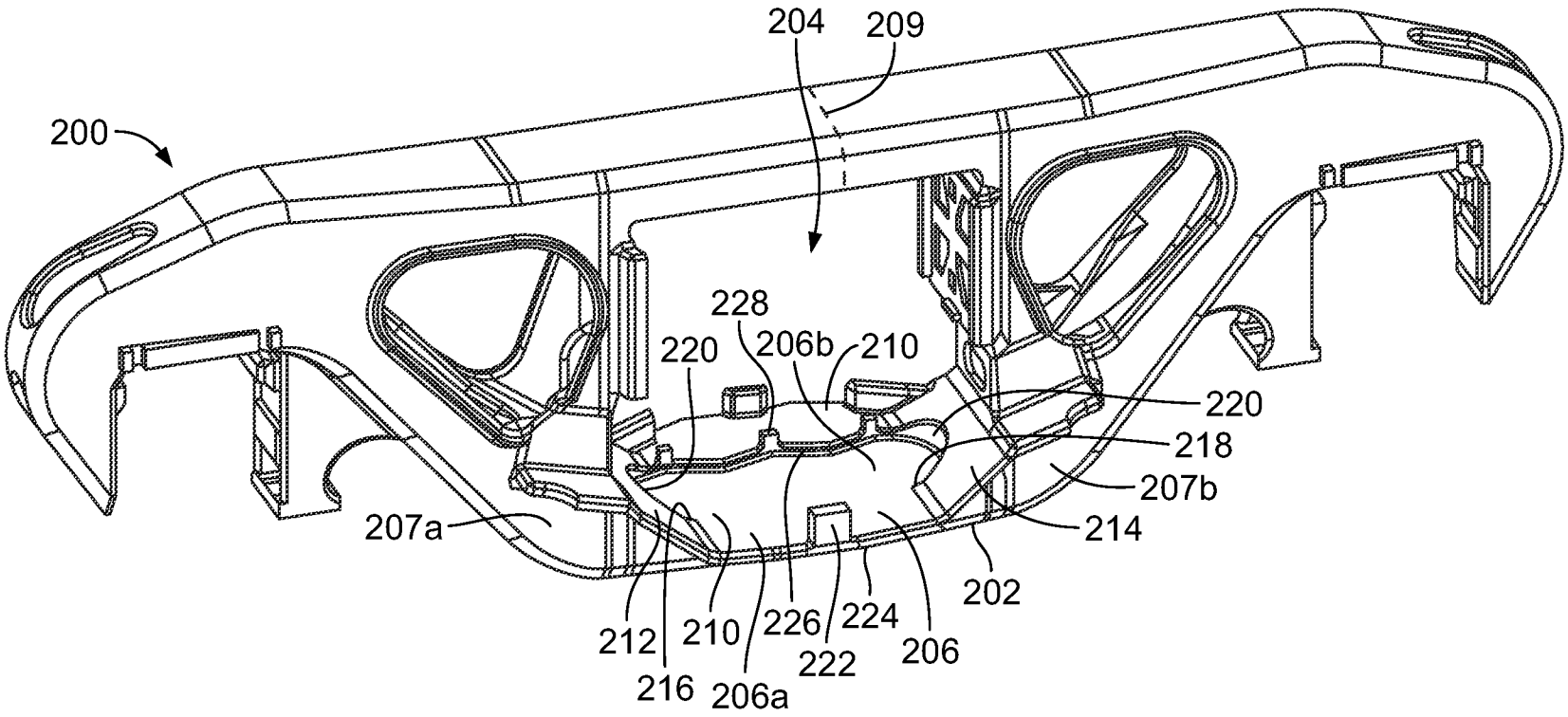
FIG. 2 illustrates a perspective side view of a side frame, according to an embodiment of the present disclosure.

FIG. 2 illustrates a perspective side view of a side frame 200, according to an embodiment of the present disclosure. The side frame 200 is an example of the side frame 106 or 108, shown in FIG. 1. The side frame 200 includes a spring seat 202 below an opening 204 (for example, a bolster opening). The spring seat 202 includes a locating pocket 206 that is sized and shaped to retain a central base of an end guide system.

In at least one embodiment, a first locating pocket 206*a* is on a first side 207*a* of the side frame 200, and a second locating pocket 206*b* is on a second side 207*b* of the side frame 200. The first locating pocket 206*a* and the second locating pocket 206*b* can be mirror image structures of one another. The first side 207*a* and the second side 207*b* are on opposite sides of a central lateral plane 209 of the side frame 200. The first locating pocket 206*a* and the second locating pocket 206*b* can be symmetrical with respect to the central longitudinal plane 209. Optionally, the first locating pocket 206*a* and the second locating pocket 206*b* may not be mirror image structures of one another. Further, optionally, the first locating pocket 206*a* and the second locating pocket 206*b* may be asymmetrical with respect to the central lateral plane 209. In at least one other embodiment, the side frame 200 includes only one locating pocket 206.

The spring seat 202 includes an upper surface 210. Ramps 212 and 214 extend upwardly from the upper surface 210 at opposite ends 216 and 218. A spring pocket 220 or channel may be formed through each ramp 212 and 214. The spring pocket 220 extends to the spring seat 202 or the locating pocket 206. An outboard tab 222 extends upwardly from the spring seat 202 at side edge 224. The outboard tab 222 can be centrally located along the lateral edge 224. An internal rim 226 extends upwardly from the spring seat 202. One or more portions of the internal rim 226 may reside within the central longitudinal plane 209. An inboard tab 228 extends upwardly from the internal rim 226. The central tab 228 may be laterally aligned with the outboard tab 222. Additional tabs can extend upwardly from the internal rim 226. In at least one embodiment, the side edge 224 can include an upstanding rim between the ramps 212 and 214 and the outboard tab 222. As shown, the locating pocket 206 is defined between the upper surface 210, the ramps 212 and 214, the side edge 224, and the internal rim 226.

The ramps 212 can be angled to conform to an angle of an end guide of an end guide system. For example, upper surfaces of the ramps 212 may support lower surface of the end guide. Optionally, the side frame 200 may not include the ramps.

The locating pocket 206 is sized, shaped, and configured to receive and retain a portion of an end guide system, such as a central base of the end system. The locating pocket 206 is sized and shaped to conform to the portion of the end guide system. The locating pocket 206 can be sized and shaped differently than shown, depending on the size and shape of the portion of the end guide system.

Figure 3:
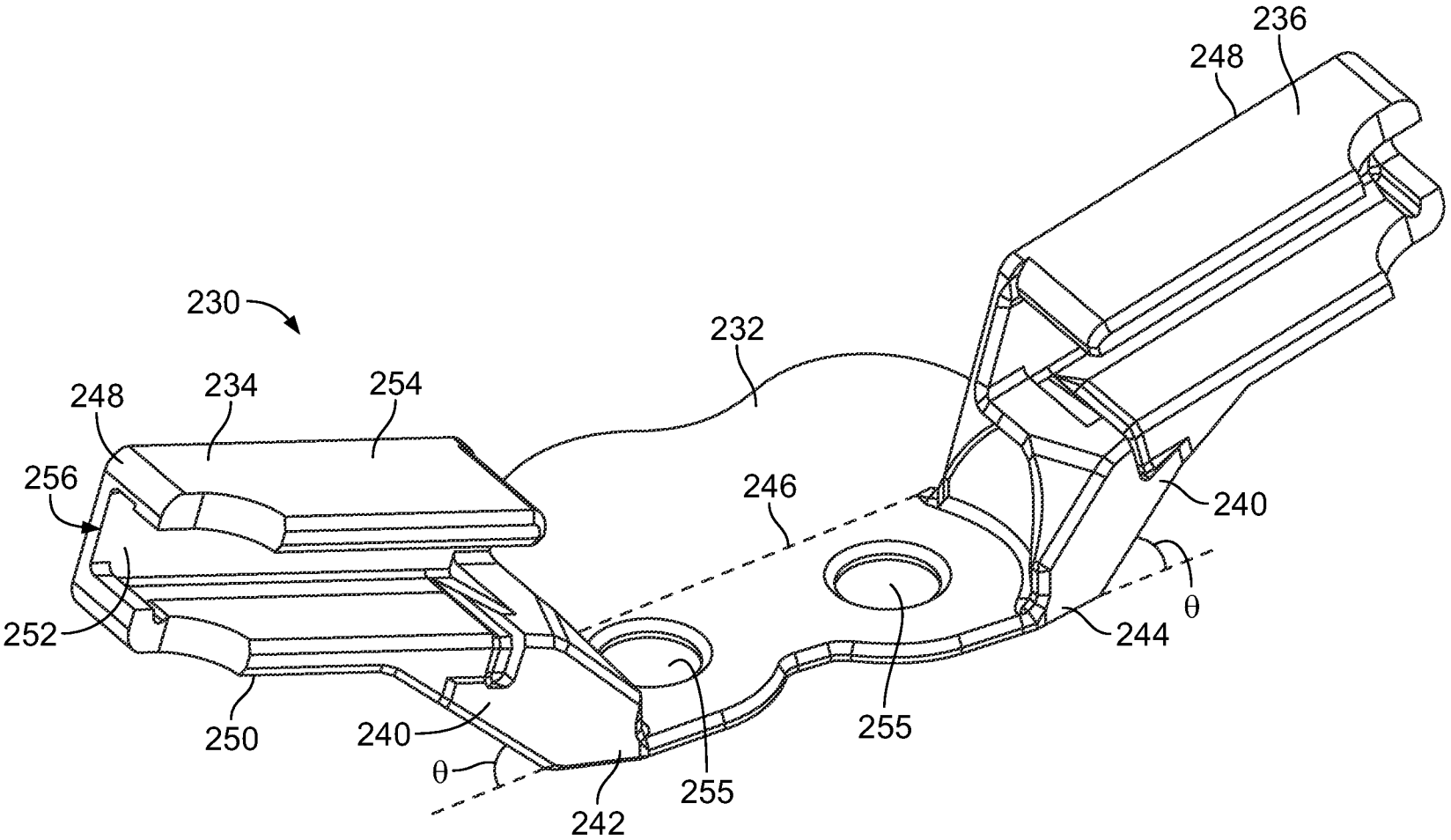
FIG. 3 illustrates a perspective side view of an end guide system, according to an embodiment of the present disclosure.

FIG. 3 illustrates a perspective side view of the end guide system 230, according to an embodiment of the present disclosure. The end guide system 230 includes the central base 232. A first end guide 234 extends outwardly and upwardly from the central base 232 at an angle Θ in relation to the central base 232. A second end guide 236 extends outwardly and upwardly from the central base 232 at an angle Θ in relation to the central base 232. In at least one embodiment, the angle Θ is greater than 0 degrees, and less than 90 degrees. For example, the angle Θ is between 10-20 degrees. Optionally, the end guide system 230 can include only one of the first end guide 234 or the second end guide 236.

The central base 232 is a flat, planar sheet or panel, for example. The central base 232 is sized and shaped to fit within the locating pocket 206.

Each of the first end guide 234 and the second end guide 236 includes an angled extension beam 240 that extends outwardly and upwardly from a first end 242 and a second end 244, respectively, of the central base 232. The angled extension beams 240 are longitudinally aligned with one another. The angled extension beams 240 can be offset (that is, not longitudinally aligned) with a central longitudinal axis 246 of the central base 232.

Brake beam end guide flanges 248 extend from the angled extension beams 240. Each brake beam end guide flange 248 includes a bottom wall 250 connected to an orthogonal interior wall 252, which, in turn, connects to a top wall 254. The bottom wall 250 and the top wall 254 may be parallel with each other, and perpendicular to the interior wall 252. A brake beam end guide pocket 256 is defined between the bottom wall 250, the interior wall 252, and the top wall 254. The brake beam end guide pockets 256 are configured to be retain and control the angle of end guides of brake beams.

In at least one embodiment, the central base 232, the first end guide 234 and the second end guide 236 are integrally molded and formed as a single unit, such as a single casting. In at least one other embodiment, the first end guide 234 and the second end guide 236 may be separated from one another and not connect together by a common central base.

The central base 232 is sized and shaped to be received and retained within the locating pocket 206 (shown in FIG. 2) of the side frame 200. For example, the central base 232 nests within the locating pocket 206.

As shown, the first end guide 234 extends from the first end 242 of the central base 232. The second end guide 236 extends from the second end 244 of the central base 232. The second end 244 is opposite from the first end 242.

One or more retaining holes 255 may be formed in the central base 232. For example, the retaining holes 255 can be formed through the central base 232 offset away from the central longitudinal axis 246. The retaining holes 255 are configured to receive bosses cast into the side frame locating pocket 206 to control the position of the central base 232 relative to the side frame 200.

Figure 4:
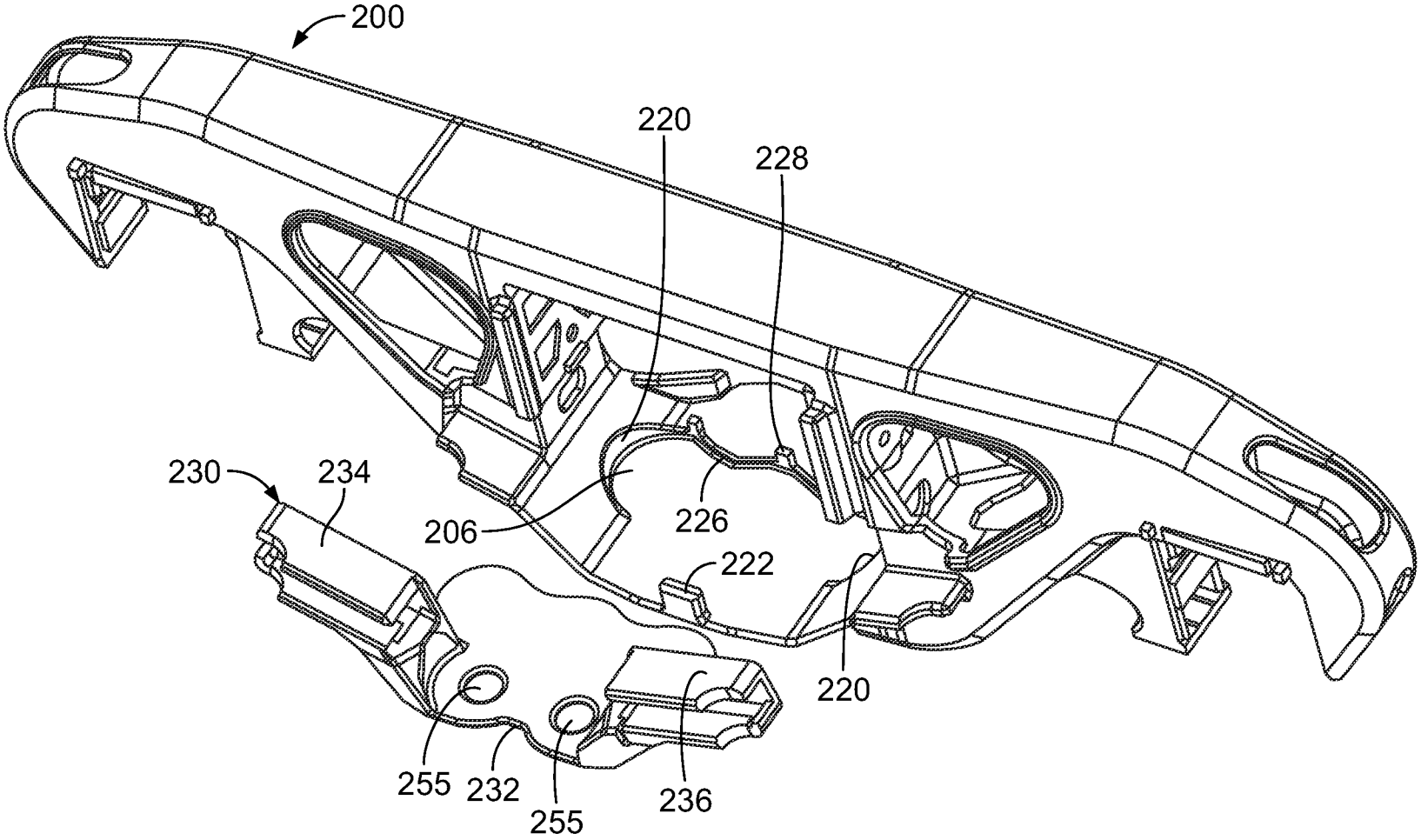
FIG. 4 illustrates a perspective top view of the end guide system separated from the side frame.
Figure 5:
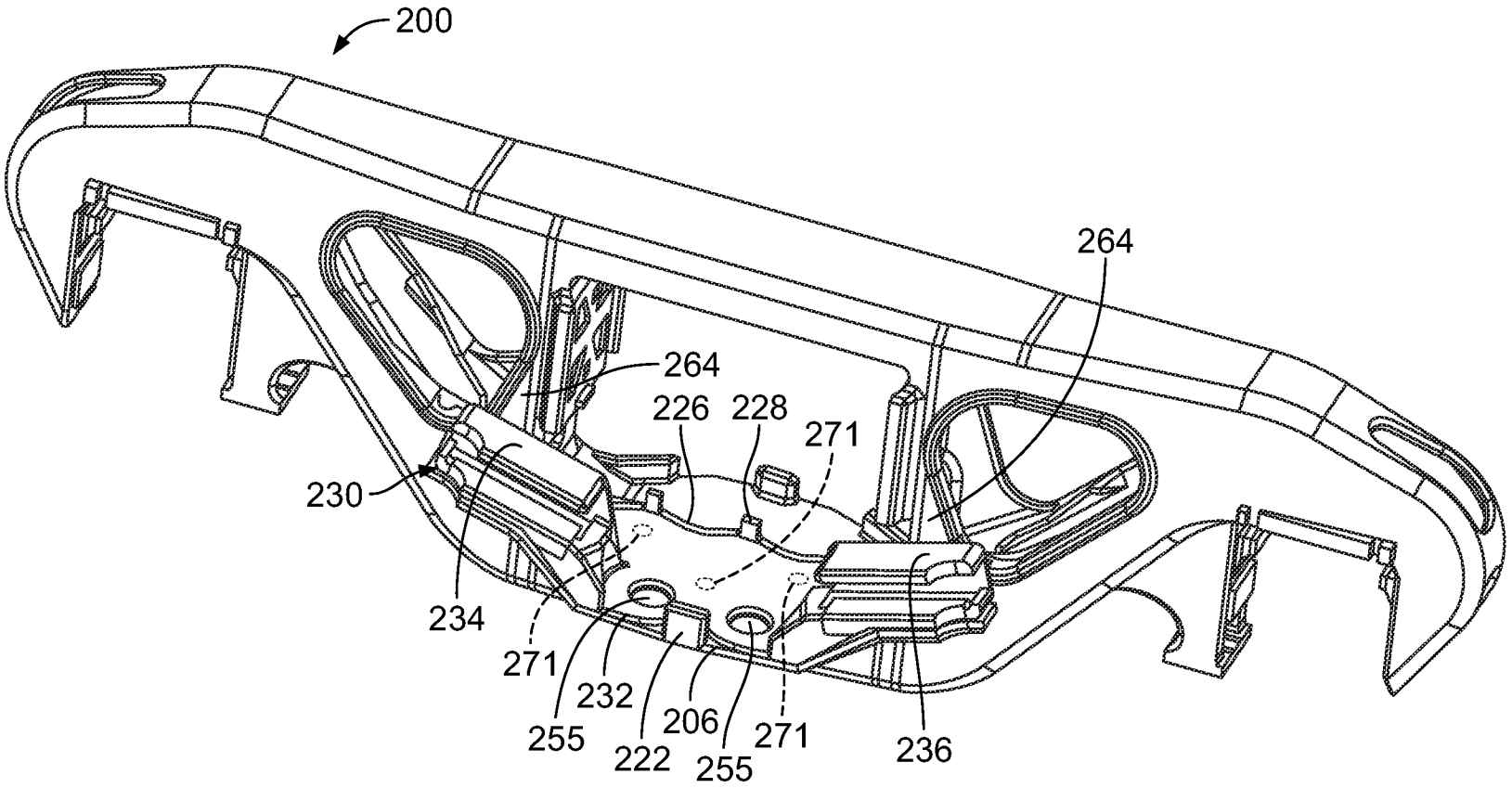
FIG. 5 illustrates a perspective top, side view of the end guide system secured to the side frame.

FIG. 4 illustrates a perspective top view of the end guide system 230 separated from the side frame 200. FIG. 5 illustrates a perspective top, side view of the end guide system 230 secured to the side frame 200. Referring to FIGS. 4 and 5, as shown, the central base 232 is longitudinally and laterally constrained within the locating pocket 206, such as by a perimeter rim (such as the internal rim 226). the ramps 212 and 214, and the tabs 222 and 228. The first end guide 234 and the second end guide 236 upwardly extend from the central base 232 and are offset (such as inboard or outboard) from interior frame walls 264 (whether inboard or outboard) of the side frame 200.

In at least one embodiment, the end guide system 230 is securely retained in place by the locating pocket 206. Locating bosses extending into the retaining holes 255 help position the central base 232, thereby further securing the end guide system 230 in place. As such, the end guide system 230 can be secured in position with respect to the side frame 200 without the use of separate and distinct fasteners. In this manner, the end guide system 230 can be removably coupled to the side frame 200. For example, the end guide system 230 can be quickly and easily secured to the side frame 200, and removed and replaced, if desired. Optionally, one or more fasteners 271 (such as screws, bolts, or the like) may be used to further secure the end guide system 230 to the side frame 200.

Figure 6:
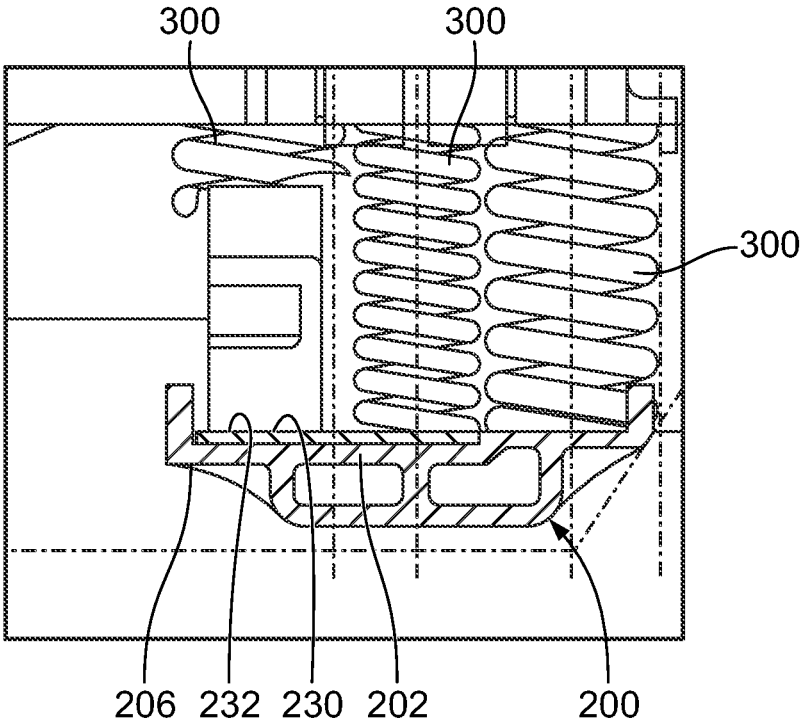
FIG. 6 illustrates a cross-sectional view of the end guide system supported within the side frame.
Figure 7:
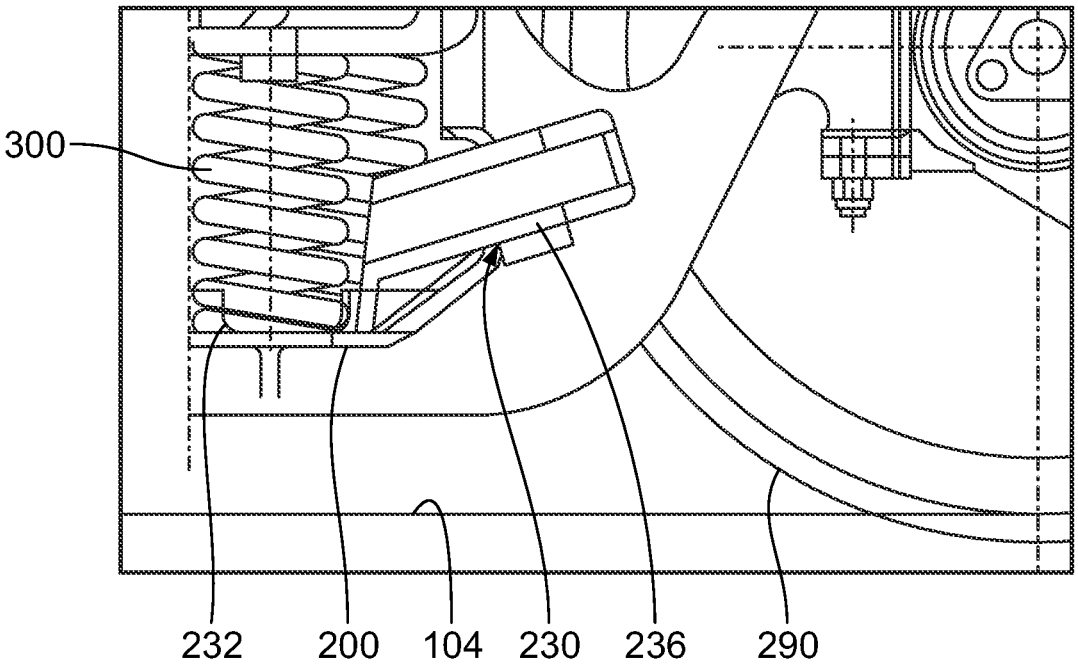
FIG. 7 illustrates a lateral view of the end guide system coupled to the side frame and engaging a wheel.

FIG. 6 illustrates a cross-sectional view of the end guide system 230 supported within the side frame 200. FIG. 7 illustrates a lateral view of the end guide system 230 coupled to the side frame 200 and engaging a wheel 290. Referring to FIGS. 6 and 7, one or more springs 300 may be used to exert a downward force into the central base 232 of the end guide system 230. At least a portion of the central base 232 is sandwiched between the spring(s) 300 and the spring seat 202 of the side frame 200.

Referring to FIGS. 1-6, certain embodiments of the present disclosure provide a method for the truck assembly 100 of a rail vehicle. The method includes removably coupling the end guide system 230 to the side frame 200. The side frame 200 includes the spring seat 202 below the opening 204. The spring seat 202 includes the locating pocket 206.

In at least one embodiment, said removably coupling includes receiving and retaining the central base 232 of the end guide system 230 by the locating pocket 206. At least one end guide 234 and/or 236 extends outwardly and upwardly from the central base 232.

In at least one embodiment, the method also includes integrally molded and forming the central base 232 and the at least one end guide 234 and/or 236 as a single piece.

As an example, the method also includes longitudinally and laterally constraining the central base 232 within the locating pocket 206.

In at least one embodiment, the method also includes retaining the central base 232 by one or both of the rim 226 or one or more tabs 222 and 228 of the locating pocket 206.

In at least one embodiment, the method also includes sandwiching at least a portion of the central base 232 between one or more springs 300 and the spring seat 202 of the side frame 200.

As an example, said removably coupling may include securing the end guide system 230 to the side frame 200 without fasteners (such as screws, bolts, or the like).

Further, the disclosure comprises embodiments according to the following clauses:

Clause 1. A truck assembly of a rail vehicle, the truck assembly comprising:

a side frame including a spring seat below an opening, wherein the spring seat includes a locating pocket; and an end guide system removably coupled to the side frame, wherein the end guide system comprises:

a central base configured to be received and retained by the locating pocket; and at least one end guide extending outwardly and upwardly from the central base.

Clause 2. The truck assembly of Clause 1, wherein the at least one end guide extends outwardly and upwardly from the central base at an angle in relation to the central base, and wherein the angle is between 10-20 degrees.

Clause 3. The truck assembly of Clauses 1 or 2, wherein the at least one guide comprises:

a first end guide extending from a first end of the central base; and a second end guide extending from a second end of the central base, wherein the second end is opposite from the first end.

Clause 4. The truck assembly of Clause 3, wherein the central base, the first end guide, and the second end are integrally molded and formed as a single piece.

Clause 5. The truck assembly of any of Clauses 1-4, wherein the central base is longitudinally and laterally constrained within the locating pocket.

Clause 6. The truck assembly of any of Clauses 1-5, wherein the locating pocket includes one or both of a rim or one or more tabs that retain the central base within the locating pocket.

Clause 7. The truck assembly of any of Clauses 1-6, wherein the side frame further comprises ramps extending upwardly from an upper surface of the spring seat at opposite ends, wherein each of the ramps includes a channel, wherein a plurality of tabs extend upwardly from the spring seat, wherein an internal rim extends upwardly from the spring seat, and wherein the locating pocket is defined between the upper surface of the spring seat, the ramps, and the internal rim.

Clause 8. The truck assembly of any of Clauses 1-8, further comprising one or more springs that exert a downward force into the central base of the end guide system, wherein at least a portion of the central base is sandwiched between the one or more springs and the spring seat of the side frame.

Clause 9. An end guide system configured to removably secure to a side frame of a truck assembly of a rail vehicle, the end guide system comprising:

a central base configured to be received and retained by a locating pocket of the side frame; and at least one end guide extending outwardly and upwardly from the central base.

Clause 10. The end guide system of Clause 9, wherein the at least one end guide extends outwardly and upwardly from the central base at an angle in relation to the central base, and wherein the angle is between 10-20 degrees.

Clause 11. The end guide system of Clauses 9 or 10, wherein the at least one guide comprises:

a first end guide extending from a first end of the central base; and a second guide extending from a second end of the central base, wherein the second end is opposite from the first end.

Clause 12. The end guide system of Clause 11, wherein the central base, the first end guide, and the second end are integrally molded and formed as a single piece.

Clause 13. A method for a truck assembly of a rail vehicle, the method comprising:

removably coupling an end guide system to a side frame, wherein the side frame includes a spring seat below an opening, and wherein the spring seat includes a locating pocket.

Clause 14. The method of Clause 13, wherein said removably coupling comprises receiving and retaining a central base of the end guide system by the locating pocket, and wherein at least one end guide extends outwardly and upwardly from the central base.

Clause 15. The method of Clause 14, further comprising integrally molded and forming the central base and the at least one end guide as a single piece.

Clause 16. The method of Clauses 14 or 15, further comprising longitudinally and laterally constraining the central base within the locating pocket.

Clause 17. The method of any of Clauses 14-16, further comprising retaining the central base by one or both of a rim or one or more tabs of the locating pocket.

Clause 18. The method of any of Clauses 14-17, further comprising sandwiching at least a portion of the central base between one or more springs and the spring seat of the side frame.

Clause 19. The method of any of Clauses 13-18, wherein said removably coupling comprises securing the end guide system to the side frame without fasteners.

Clause 20. The method of any of Clauses 13-19, wherein the side frame further comprises ramps extending upwardly from an upper surface of the spring seat at opposite ends, wherein each of the ramps includes a channel, wherein a plurality of tabs extend upwardly from the spring seat, wherein an internal rim extends upwardly from the spring seat, and wherein the locating pocket is defined between the upper surface of the spring seat, the ramps, and the internal rim.

As described herein, certain embodiments of the present disclosure provide effective and efficient systems and methods for adapting brake beam end guides to unconventional, modified, or otherwise different types of truck assemblies for a rail vehicle. Further, certain embodiments of the present disclosure provide brake beam end guide systems and methods that can be used with non-standard truck assemblies.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

The invention claimed is:

1. A truck assembly of a rail vehicle, the truck assembly comprising:

a side frame including a spring seat below an opening, wherein the spring seat includes ramps extending upwardly from an upper surface of the spring seat at opposite ends, wherein each of the ramps includes a channel, wherein tabs extend upwardly from the spring seat, wherein an internal rim extends upwardly from the spring seat, and wherein a locating pocket is defined between the upper surface of the spring seat, the ramps, and the internal rim; and an end guide system removably coupled to the side frame, wherein the end guide system comprises:

a central base configured to be received and retained by the locating pocket; and at least one end guide extending outwardly and upwardly from the central base.

2. The truck assembly of claim 1, wherein the at least one end guide extends outwardly and upwardly from the central base at an angle in relation to the central base, and wherein the angle is between 10-20 degrees.

3. The truck assembly of claim 1, wherein the at least one guide comprises:

a first end guide extending from a first end of the central base; and a second end guide extending from a second end of the central base, wherein the second end is opposite from the first end.

4. The truck assembly of claim 3, wherein the central base, the first end guide, and the second end are integrally molded and formed as a single piece.

5. The truck assembly of claim 1, wherein the central base is longitudinally and laterally constrained within the locating pocket.

6. The truck assembly of claim 1, further comprising one or more springs that exert a downward force into the central base of the end guide system, wherein at least a portion of the central base is sandwiched between the one or more springs and the spring seat of the side frame.

7. The truck assembly of claim 1, wherein the spring seat further comprises an additional locating pocket.

8. The truck assembly of claim 7, wherein the locating pocket and the additional locating pocket are mirror image structures of one another.

9. An end guide system configured to removably secure to a side frame of a truck assembly of a rail vehicle, the end guide system comprising:

a central base configured to be received and retained by a locating pocket of the side frame, wherein the side frame comprises a spring seat that includes ramps extending upwardly from an upper surface of the spring seat at opposite ends, wherein each of the ramps includes a channel, wherein tabs extend upwardly from the spring seat, wherein an internal rim extends upwardly from the spring seat, and wherein the locating pocket is defined between the upper surface of the spring seat, the ramps, and the internal rim; and at least one end guide extending outwardly and upwardly from the central base.

10. The end guide system of claim 9, wherein the at least one end guide extends outwardly and upwardly from the central base at an angle in relation to the central base, and wherein the angle is between 10-20 degrees.

11. The end guide system of claim 9, wherein the at least one guide comprises:

a first end guide extending from a first end of the central base; and a second guide extending from a second end of the central base, wherein the second end is opposite from the first end.

12. The end guide system of claim 11, wherein the central base, the first end guide, and the second end are integrally molded and formed as a single piece.

13. The end guide system of claim 9, wherein the central base is configured to be longitudinally and laterally constrained within the locating pocket.

14. The end guide system of claim 9, wherein one or more springs exert a downward force into the central base of the end guide system, wherein at least a portion of the central base is configured to be sandwiched between the one or more springs and the spring seat of the side frame.

15. A method for a truck assembly of a rail vehicle, the method comprising:

removably coupling an end guide system to a side frame, wherein the side frame includes a spring seat below an opening, and wherein the spring seat includes ramps extending upwardly from an upper surface of the spring seat at opposite ends, wherein each of the ramps includes a channel, wherein a plurality of tabs extend upwardly from the spring seat, wherein an internal rim extends upwardly from the spring seat, and wherein a locating pocket is defined between the upper surface of the spring seat, the ramps, and the internal rim.

16. The method of claim 15, wherein said removably coupling comprises receiving and retaining a central base of the end guide system by the locating pocket, and wherein at least one end guide extends outwardly and upwardly from the central base.

17. The method of claim 16, further comprising integrally molded and forming the central base and the at least one end guide as a single piece.

18. The method of claim 16, further comprising longitudinally and laterally constraining the central base within the locating pocket.

19. The method of claim 16, further comprising sandwiching at least a portion of the central base between one or more springs and the spring seat of the side frame.

20. The method of claim 15, wherein said removably coupling comprises securing the end guide system to the side frame without fasteners.

* * * * *